United States Patent [19]

Bódás et al.

[11] Patent Number: 4,538,677

[45] Date of Patent: Sep. 3, 1985

[54] HELICOIDALLY FINNED TUBES

[75] Inventors: János Bódás; Árpád Bakay; István Papp; György Pálfalvi; Gyula Kovács, all of Budapest, Hungary

[73] Assignee: Energiagazdalkodasi Intezet, Budapest, Hungary

[21] Appl. No.: 482,291

[22] Filed: Apr. 5, 1983

[30] Foreign Application Priority Data

Apr. 6, 1982 [HU] Hungary ..... 1057/82

[51] Int. Cl.[3] ..... F28F 1/36

[52] U.S. Cl. ..... 165/146; 165/184

[58] Field of Search ..... 165/181, 182, 184, 146, 165/147

[56] References Cited

U.S. PATENT DOCUMENTS

| | | | |
|---|---|---|---|
| 2,667,337 | 1/1954 | Chapman | 165/184 |
| 2,731,245 | 1/1956 | McChesney | 165/184 X |

FOREIGN PATENT DOCUMENTS

| | | | |
|---|---|---|---|
| 322494 | 11/1918 | Fed. Rep. of Germany | 165/184 |
| 356877 | 12/1905 | France | 165/182 |
| 13965 | 5/1901 | Sweden | 165/182 |
| 284 | of 1914 | United Kingdom | 165/182 |
| 340765 | 9/1930 | United Kingdom | 165/184 |

*Primary Examiner*—Albert W. Davis, Jr.
*Assistant Examiner*—Peggy A. Neils
*Attorney, Agent, or Firm*—Young & Thompson

[57] ABSTRACT

A helicoidally finned tube for use mainly in heat exchangers. The tube comprises a cylindrical tubular member which carries or is integral with a helical member the turns of which form the fins of the tube. The fins are provided with ripples which extend from the outer rim of the fins inwardly and the depth of which diminishes toward the tube center. The ripples serve for diverting a cooling medium inwardly to hotter parts of the tube thereby improving its heat transfer performance. The helicoidal member has rippled sections alternately with level sections, the rippled sections subtending an angle not exceeding about 90 degrees and both types of sections on successive turns registering with one another in the direction of the axis of the tubular member. The spacing of the sections is substantially equal to a quarter of the circumference of the tubular member so that the rippled sections of the helicoidal member occupy diametrically opposed positions on the tubular member, the ripples being disposed generally transverse to the direction of airflow. The ripple-free sections, thus positioned, facilitate removal of impurities precipitated in the fin gaps (FIG. 9).

1 Claim, 12 Drawing Figures

HELICOIDALLY FINNED TUBES

BACKGROUND OF THE INVENTION

1. Field of the Invention

This invention relates to helicoidally finned tubes and more particularly to heat exchanger tubes of such type.

2. Description of the Prior Art

As is known, heat transfer between fluids of different heat transfer coefficients is obtained, among other ways, by means of helicoidally finned tubes which consist of an inner tubular member and an outer helical member. The turns of the helical member form the fins of the tubes. The fluid of greater heat transfer coefficient such as liquids or condensing vapours flows in the tubular member. The fluid of smaller heat transfer coefficient such as gases or air flows between the turns—the fins—of the helical member at right angles to the longitudinal or principal axis of the tubular member and, thus, to the finned tube itself.

Helicoidally finned tubes having solid helical surfaces the generatrix of the turns of which is at right angles to the axis of the tubular member are already known. Such geometry permits adopting simple manufacturing methods which consist either in winding and fixing a band of rectangular or L-shaped cross sectional configuration onto the tubular member or in die-rolling helical ribs from the body thereof. In the latter case the turns of the helical member have outwardly diminishing cross sectional areas which means outwardly increasing gaps between the fins. In either case heat transfer is uneven along the radial extent of the fins which is undesirable for thermodynamic reasons because it results in relatively low mean temperatures of the exiting external fluids as will immediately be explained:

If, for instance, the tubular member has a fluid flowing in it which is warmer than air, the temperature of the fins decreases with increasing distances from the tubular member. At the same time the flow rate of air increases in the same direction because in the gaps between the fins less air will flow in the proximity of the tubular member than farther out. This is due to inwardly increasing flow resistances met by the external fluid. Namely, the flow path of air is longer in the central regions of the fins than at the periphery thereof. In addition, air flowing at the base of the fins contacts the outer surface of the tubular member, in contrast to the air flowing at the periphery which sweeps the side surfaces of the fins only. Such difference is even more pronounced with tubes having die-rolled fins where besides a radial and outward decrease of flow path lengths also the gaps between adjacent fins widen towards the periphery thereby augmenting the cross sectional flow area of air and diminishing the flow resistance thereagainst.

Thus, air flow in the gaps between adjacent fins is uneven which is responsible for the already mentioned low values of the mean temperature of the exiting air.

SUMMARY OF THE INVENTION

The main object of the present invention is to provide as even a flow as possible of a fluid through the gaps between solid fins of a helicoidally finned tube and, thereby, to increase their heat transfer capacity or, in other words, to form tubes of such type which are economically superior to those of the prior art. In accordance with what has been explained above such economical increase in the performance of helicoidally finned tubes can be obtained if the bulk of the external fluid sweeping the tube be forced to flow in the proximity of the hot tubular member rather than at the relatively cold periphery of the turns of the helical member.

Thus, the invention aims at the provision of a helicoidally finned tube with which an external fluid is directed between the turns of the helical member towards the outer surface of the tubular member of a finned tube so that more favourable heat transfer conditions of relatively warmer surfaces will prevail.

The basic idea of the invention is that such direction can simply be obtained by solid fins the shape of which is other than planar. More particularly, if the fins are provided with ripples the depth of which decreases in an inward direction, also the flow resistance to be met by the external fluid will vary in a similar manner which means that more fluid will flow in the proximity of the tubular member than at the outer periphery of the helical member. Where the ripples are deeper, the fluid flow may even part with the fin surface. Then eddies will form behind the ripples. On the one hand, such eddies increase the flow resistance and, thereby, the diversion effect. On the other hand, they cause a detachment of the boundary layers sweeping the fin surfaces and, thereby, entail an increase of the heat transfer coefficient of the peripheral portions of the fins. The total effect is an increase of the mean temperature of the fluid exiting from along the whole radial length of the turns of the finned tube.

In summary, the invention is concerned with helicoidally finned tubes which, in a manner known per se, consist of a cylindrical inner tubular member and an outer helical member the solid turns of which are perpendicular to the principle or central axis of the tubular member. The finned tubes according to the invention are distinguished over the prior art in that the turns of the helical member that is the fins of the tube are provided with ripples which extend from the outer periphery of the turns towards their base and the depth of which decreases in the direction towards the tubular member.

Finned tubes meant for heat exchangers in which the fins of the tube are provided with ripples the depth of which decreases towards the center of the tube are already known. Such finned tubes are disclosed e.g. in Hungarian patent No. 136,634. However, the fins of the prior device are disks which have to be positioned on a tubular member individually rather than solid turns of a helical member because they are indented according to a given pattern so as to increase the heat transfer capacity by breaking the air flow. However, such indenting can be carried out in sheet form of the fin material only. Due to the indentations the air flow is not only broken but also let through the fins rather than being baffled towards the tubular member. Thus, in the known device, the problem, object and solution are all different from those of the invention.

German early publication No. 1 527 860 discloses a finned tube in which a band is wound onto a tubular member. Previously, both sides of the band have been provided with undulations of inwardly decreasing depth. Such undulations comprise peripheral portions of the wound up band and permit the use of extremely thin steel strips and materials of low tensile strength such as aluminium without the danger of breaking. Prior to winding the sides of the band are bent up whereby a helicoid of asymmetric turns is obtained the plane of the turns of which is not perpendicular to the principal axis of the finned tube so that two kinds of gaps between fins will be present. In addition, the undulations are practically straightened out in the course of winding. Thus, the prior device is obviously unsuitable for obtaining an even air flow because, on the one hand, practically there are no ripples effective to divert the external fluid towards the tubular member and, on the other hand, the presence of two kinds of gaps between the fins causes ab ovo an asymmetry in the fluid flow since in one of two adjacent gaps heat transfer is necessarily better than in its fellow gap.

In contrast, the invention provides a uniformity of gaps by employing turns the plane of which lies at right angles to the principal axis of the tube. Baffling is rendered possible by employing solid helicoidal surfaces. Ripples with inwardly decreasing depth ensure that fin portions of elevated temperature are supplied with relatively more fluid. The total effect is again a rise in the mean temperature of the exiting fluid and, thereby, in the efficiency of heat transfer.

Preferably, ripples projecting in the same direction from a pair of adjacent turns of the helical member register with one another in the direction of the principal axis of the tubular member. On the one hand, with such arrangement ripples of greater depth at the periphery of the fins generate eddies and, thereby, increase both the flow resistance and the heat transfer coefficient. On the other hand, such registering results in gaps of uniform width which, in turn, promotes uniform flow rates and, thus, with less probability of dust particles and other impurities being precipitated in the gaps between the fins.

However, a pair of adjacent turns may occupy mutual positions in which ripples projecting in opposite directions from a pair of adjacent turns of the helical member register with one another in the direction of the principal axis of the tubular member. Such registering is responsible for alternate accelerations and decelerations in the fluid flow the cross sectional area of which varies between increasingly distanced values towards the outer periphery of the fins. Such fluctuations in the fluid flow further increase the peripheral flow resistance and, thereby, the inwardly directed diverting effect and the efficiency of heat transfer. At the same time, tendency to dust precipitation is practically negligible since it is counteracted by the pulsating nature of fluid flow.

Within an axial portion of the helical member the ripples may have at least partly different spacings whereby one and the same helicoidally finned tube will be distinguished by the simultaneous presence of the advantages of both previously described expedients.

Furthermore, the provision of ripples may be restricted to diametrically opposite peripheral sections of the turns of the helical member, each rippled section having a central angle preferably not greater than 90 degrees. If such finned tubes are built so that the rippled sections lie in the flow direction of the external fluid, then inlet and outlet sections of the fins will be free from ripples whereby the removal of impurities precipitated in the gaps between the fins will substantially by facilitated.

The ripples may be asymmetrical with respect to the plane of the turns of the helical member. For instance, they may protrude from the fins on one side only. Such asymmetric arrangement has its significance as regards manufacture as will be apparent to the skilled art worker.

The ripples may have angular cross sectional configurations with the advantage of enhancing breaking and eddying of the external fluid flow and, thereby, increasing the heat transfer coefficient.

BRIEF DESCRIPTION OF THE DRAWING

The invention will hereinafter be described in more detail by reference to the accompanying drawings which show various exemplified embodiments of the invention and in which.

The same reference characters refer to similar details throughout the figures of the drawings.

DESCRIPTION OF PREFERRED EMBODIMENTS

Figure 1:
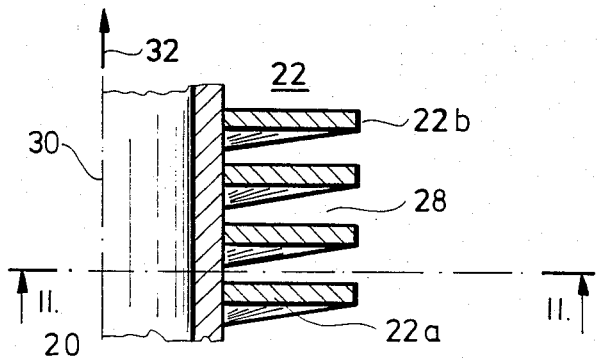
FIG. 1 is a longitudinal sectional view of a conventional helicoidally finned tube.
Figure 2:
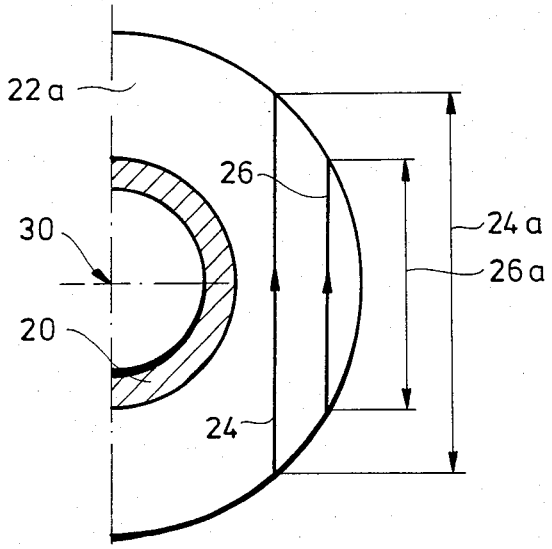
FIG. 2 shows a sectional view taken along the line II—II of FIG. 1.

In principle, a conventional helicoidally finned tube is built up as shown in FIGS. 1 and 2 of the drawings. An inner cylindrical and tubular member 20 carries a solid helical member or helicoid 22 which snugly surrounds the former and may be integral therewith as in the case of die-rolled fins. The generatrix of the turns 22*a* of the helical member encloses a right angle with the generatrices of the tubular member 20. The fins of the helicoidally finned tube are formed by the turns 22*a* of the helical member 22.

As is known, cooling air or another gaseous fluid flows at right angles with respect to the generatrices of the tubular member 20 as indicated by arrows 24 and 26 in FIG. 2. Due to such mutual positions of tube and fluid flow direction the flow path of air in the proximity of the tubular member 20 is the longest and becomes gradually shorter towards the outer rim or border 22*b* of the fin as demonstrated by decreasing lengths 24*a* and 26*a* of the arrows 24 and 26, respectively. Moreover, also the surface swept by air is greater in the neighbourhood of the tubular member than at the periphery of the fin because at its inner side the cross sectional flow area of air contacts, in addition to the confining fin surfaces, the surface of the tubular member as well. This means that considerably larger areas are swept by air at the base of the fins than further out. Thus, in the proximity of the tubular member 20 relatively less air will flow in the gaps 28 between the turns 22*a* than at a distance therefrom.

It is such uneven distribution of the air flow which considerably impairs the cooling properties of the tube, and, thereby the thermodynamic balance of heat transfer.

Figure 3:
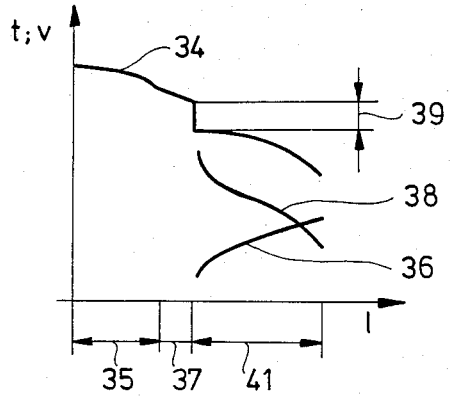
FIG. 3 represents a diagram.

This clearly appears from the graph shown in FIG. 3 in which the temperature t and the air flow velocity v are plotted against the distance l from the principal axis 30 of the helicoidally finned tube when the tubular member 20 has a medium of higher heat transfer coefficient flowing in it in the direction of arrow 32 while the fins are swept by a medium of lower heat transfer coefficient flowing between the turns 22*a* in the direction of arrows 24 and 26.

Temperature variations along the cross sectional area of the helicoidally finned tube are represented by a temperature curve 34. Section 35 of the latter is characteristic of a heat transmission between the medium flowing in the tubular member 20 and the metallic wall thereof. Its section 37 shows the course of heat conduction in the wall of the tubular member 20. The vertical section 39 of the temperature curve 34 represents a temperature drop due to the joint between tubular member 20 and helical member 22. Section 41 illustrates a temperature decrease caused by a finite heat transfer coefficient of the fin.

While the temperature of the fins decreases with the distance from the tubular member 20, velocity and quantity of air flowing in the fin gaps 28 increase in the same direction as demonstrated in FIG. 3 by curve 36 which illustrates variations in the velocity v of the air flow. Causes of the increase of velocity v the outward radial direction have already been explained hereinbefore in terms of radial variations of flow path of the air and surface areas swept by it (arrows 24 and 26).

Variations in the temperature of the air exiting from the fin gaps 28 are represented by the temperature curve 38 of the diagram shown in FIG. 3: the temperature of air progressively decreases with the distance from the tubular member 20 and is substantially lower at the outer rim of the fins than in the proximity of the tubular member. Consequently, if air flowing in the fin gaps 28 along the outer periphery of fins is diverted towards the tubular member 20 where it can contact surfaces of elevated temperature, the temperature curve 38 becomes more horizontal which means a higher mean temperature of the exiting air and, thereby, a more efficient heat transfer.

Figure 4:
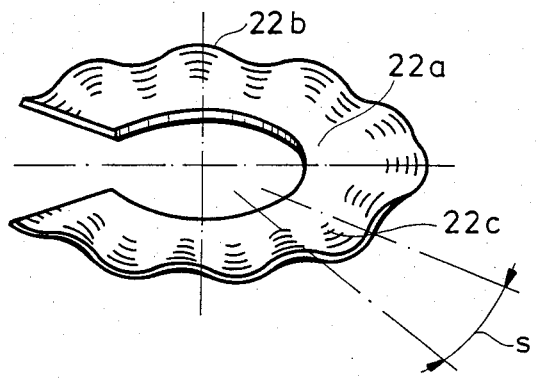
FIG. 4 illustrates a perspective view of an exemplified detail.

As has been mentioned, the air flowing in the fin gaps 28 will, in compliance with the main feature of the invention, be diverted towards the tubular member 20 if the turns 22*a* of the helical member 22 are provided with ripples which extend from the outer periphery 22*b* of the fins and the depth of which decreases towards the tubular member 20. Such a turn 22*a* is shown in FIG. 4. One of the ripples is designated by reference character 22*c*. As will be apparent, the technical term "ripple" refers to portions of the turn 22*a* which project from the turn plane between a pair of radii in one axial direction. As illustrated in FIG. 4, ripples 22*c* may project from the plane of the turn 22*a* on both sides thereof and merge into one another in an undulatory manner with spacings s.

Figure 5:
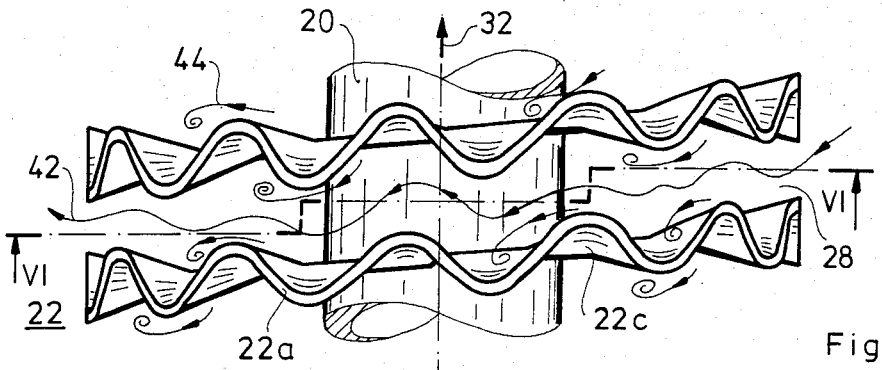
FIG. 5 shows, by way of example, a side elevational view of an embodiment of the helicoidally finned tube according to the invention.
Figure 6:
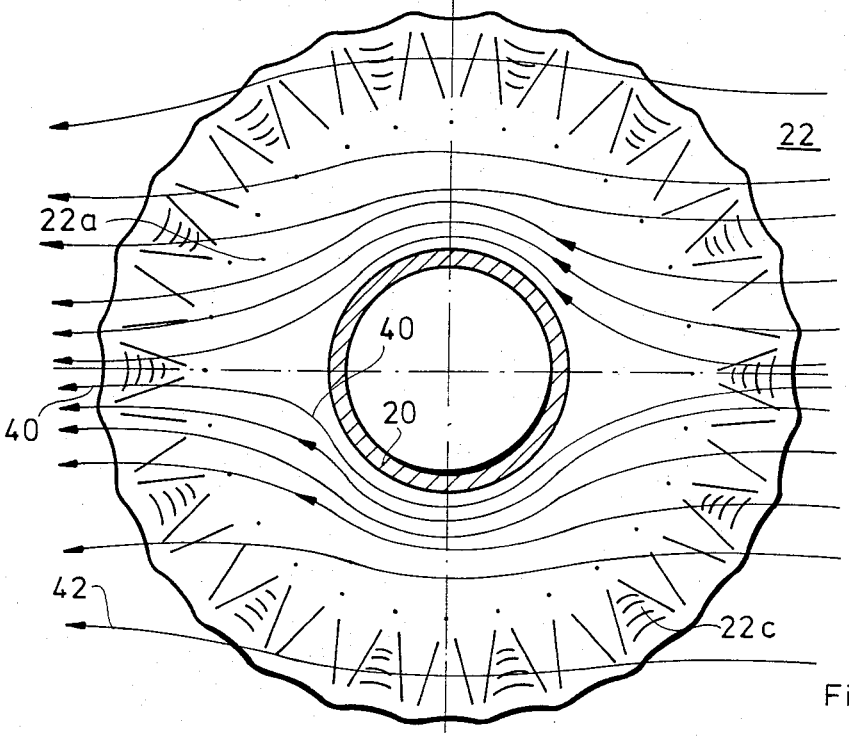
FIG. 6 is a sectional view taken along the line VI—VI of FIG. 5.

A helical member 22 consisting of turns 22*a* and provided with ripples 22*c* is shown on a tubular member 20 in FIGS. 5 and 6 of which FIG. 5 illustrates an axial portion of a helicoidally finned tube, and FIG. 6 represents a cross sectional area thereof. In the represented embodiment ripples 22*c* projecting from the medial plane of a pair of adjacent turns 22*a* of the helical member 22 in the direction of the principal or central axis 30 of the tubular member 20 register with one another because the peripheral length of the fins is an integral multiple of the spacing s of the ripples 22*c*.

If, in operation, the flow of cooling air impinges on the finned tube from right to left as seen in the drawing, the air flow will be shaped as indicated by a host of arrows in FIGS. 5 and 6. More particularly:

Where the air flow reaches the fin gaps 28 the direction of arrow 40 opposite to the ripples 22*c*, it meets hardly any flow resistance so that it exits without essential direction changes after sweeping the surfaces of the tubular member 20 and of the base of the fins or turns 22*a*. This means a contact with the hottest part of the finned tube and, thereby, a suitable cooling.

In contrast, where the air flow reaches the ripples 22*c* laterally as e.g. in case of arrow 42, air is compelled to undergo an undulatory flow that is to undergo a repeated change of flow direction as shown in FIG. 5. This per se means an elevated flow resistance. In addition, where the ripples 22*c* are relatively deeper that is at the periphery of the fins, the air flow will part with the fin surface when leaving a wave crest and will become turbulent as suggested by small arrows 44 in FIG. 5. Flow resistance is further increased thereby. At the same time by a breaking of the boundary layers of a laminar flow also the heat transfer coefficient is considerably increased.

Due to such locally increased flow resistance the flowing air will try to pass the finned tube at portions of lower flow resistance of the fin gaps 28 that is in the proximity of the tubular member 20 where ripples 22*c* already disappear or are too shallow to cause any flow disturbances. Consequently, air flow is concentrated in regions close to the tubular member 20 that is to places of highest temperatures as suggested by the density of the host of arrows in FIG. 6.

At the same time—as has been hinted at—relatively small amounts of air flowing over the rims of the fins improve the heat transfer coefficient by breaking the border layers of laminar air flow so that this air as well exits at relatively higher temperatures. Due to such flow conditions the temperature curve 38 of the exiting air becomes—as it were—more horizontal which is equivalent to an increase of both the mean temperature and, thereby, the intensity of heat exchange. This, however, is the main purpose of the invention.

Since, in the axial direction, the ripples of adjacent fins occupy similar angular positions and, thus, register with one another, the cross sectional flow areas are practically the same even in rippled portions of the fin gaps. This means a relatively uniform flow velocity which counteracts a precipitation of impurities probably carried along with flowing air.

Figure 7:
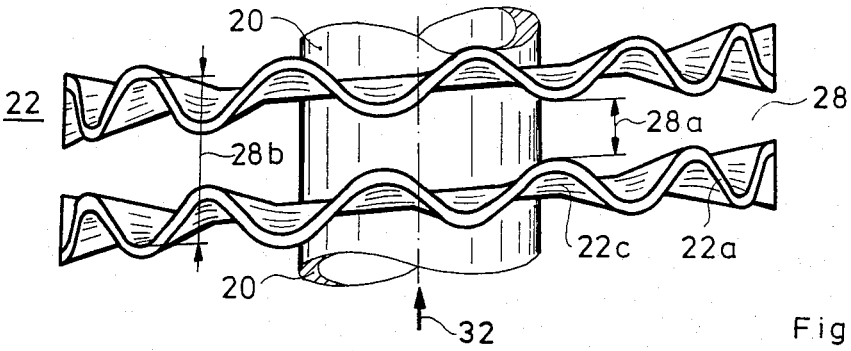
FIG. 7 represents a side elevational view of a further exemplified embodiment of the invention.

The exemplified embodiment according to FIG. 7 is distinguished from the previous one in that the circumference of the fins is by half of the spacing s greater than an integral multiple of the spacing s and, thus, in the direction of the axis 30 of the tubular member 20 ripples 22*c* projecting from the turn plane of a pair of adjacent turns 22*a* in opposite directions register with one another. Therefore, where the ripples of a pair of adjacent turns project towards each other as at 28*a* in FIG. 7, flow velocity increases. On the other hand, where registering ripples 22*c* point away from one another as e.g. at 28*b* of the fin gap 28, the flow velocity becomes relatively lower. Such alternate acceleration and deceleration at the periphery of the fins further increases the flow resistance and, thereby, the inwardly directed baffling action. Depending on circumstances, it means an improvement of heat transfer although probable precipitation of impurities is somewhat enhanced as well which, however, as a rule, does not counterbalance the improvement obtained in heat transfer properties of the finned tube.

The expedients shown in FIGS. 5 and 6 as well as in FIG. 7, respectively, may be employed also simultaneously. Such combination will be obtained if within an axial length or portion of the helical member the ripples follow one another by different spacings.

Figure 8:
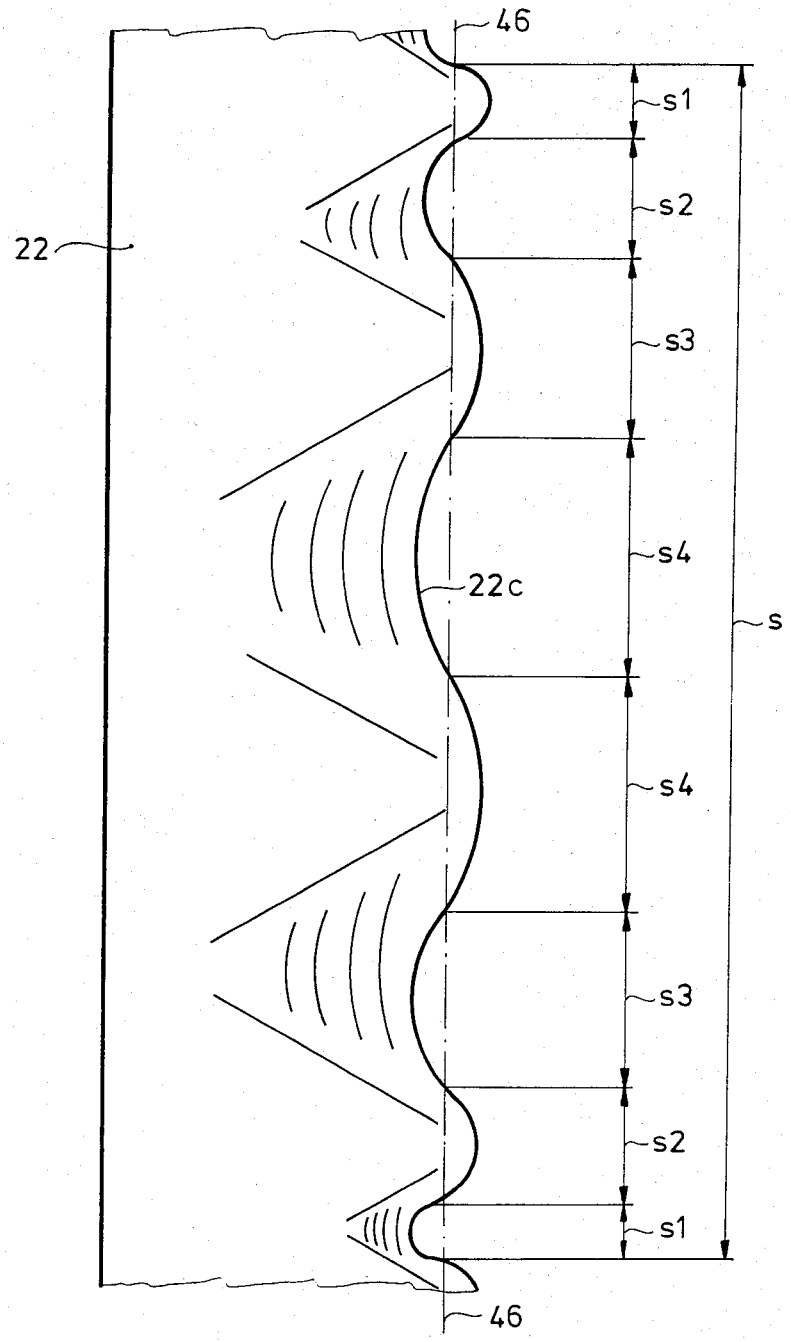
FIG. 8 illustrates a side elevational view of an unbent detail of a fin.

An exemplified embodiment of a helical member with different spacings of the ripples is partly shown unfolded in FIG. 8. It will be seen that within an axial portion or section S of a helical member 22 there are four kinds of spacings s1, s2, s3 and s4 between the ripples 22*c* which gradually increase from s1 to s4 while the ripples 22*c* lie alternately on opposite sides of a plane of symmetry indicated by a dash-and-dot line 46 and coinciding with the plane of the turns of the helicoid. Obviously, in the case of such helical member 22 ripples 22*c* of adjacent turns 22*a* may occupy the most varied mutual angular positions and may alternately overlap each other, register with one another and meet oppositely, respectively, as the case may be. Thus, effects of various flow resistances will, as it were, complement each other.

It will be understood that not only the spacings within a section S may be different but also the sections S themselves may differ from one another. What matters is that the ripples have at least partly different spacings and, thereby, ensure a simultaneous presence of the effects of various flow resistances.

Figure 9:
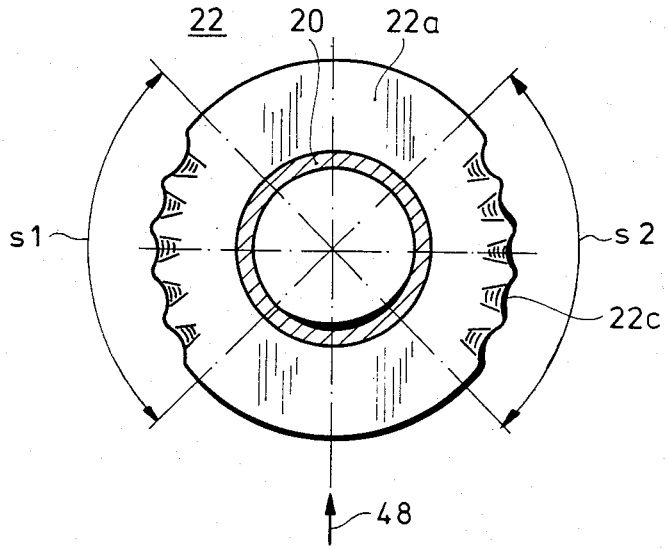
FIG. 9 shows a cross sectional view of another exemplified embodiment of the invention.

FIG. 9 shows, by way of example, an embodiment of the invention in which the employment of ripples 22*c* is restricted to diametrically opposite sections S1 and S2 of the turns 22*a* of a helical member 22. Such finned tubes have to be built so that the rippled sections S1 and S2 lie in the flow direction of cooling air indicated by an arrow 48 in the drawing.

In the represented embodiment the central angle of the sections S1 and S2 amounts to 90 degrees, and, as shown in FIG. 9, the arrow 48 is perpendicular to the bisector of each of those angles. Preferably, no greater values for the central angles will be selected since the significance of such expedient lies in that ripple-free sections facilitate removal of impurities precipitated in the fin gaps. The absence of ripples between the sections S1 and S2 does not essentially influence the heat transfer properties of the finned tubes according to the invention because the rippled sections occupy portions of the circumference of the fins where the velocity of air flowing between the fins is the highest and, thus, rippling is most efficient as regards air flow and heat transfer.

Hereinbefore only embodiments have been described in which the ripples project in both directions and to the same extent from the plane of the turns of the helical member. However, ripples on both sides of the medial plane may also have different heights. Moreover, for reasons of manufacturing facilities the use of helical members may be preferable which have ripples projecting from the medial plane in one direction only. In both cases, the ripples are asymmetric with respect to the medial plane of the helicoid. One-sided ripples can obviously be produced by means of relatively simple tooling even if the ripples have different heights.

Figure 10:
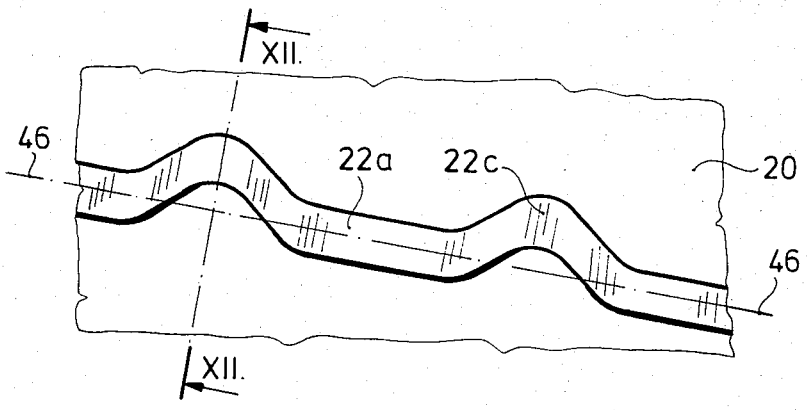
FIG. 10 is a side elevational view of a detail of still another exemplified embodiment.

A detail of a turn of a helicoidally finned tube provided with such asymmetric ripples 22*c* is represented in FIG. 10. As will be appreciated, ripples 22*c* are provided but above the plane of the turn 22*a*, the plane being indicated by its trace line 46.

The ripples 22*c* of the exemplified embodiments shown in FIGS. 4 to 9 compose essentially a wavy form while in the embodiment shown in FIG. 10 they are arcuate surfaces. Both kinds of ripple form favour laminar flow. Detachment of flowing air and, more particularly, breaking of border layers and, thereby, increasing of flow resistance may be enhanced by employing ripples of sharp angled cross sectional areas.

Figure 11:
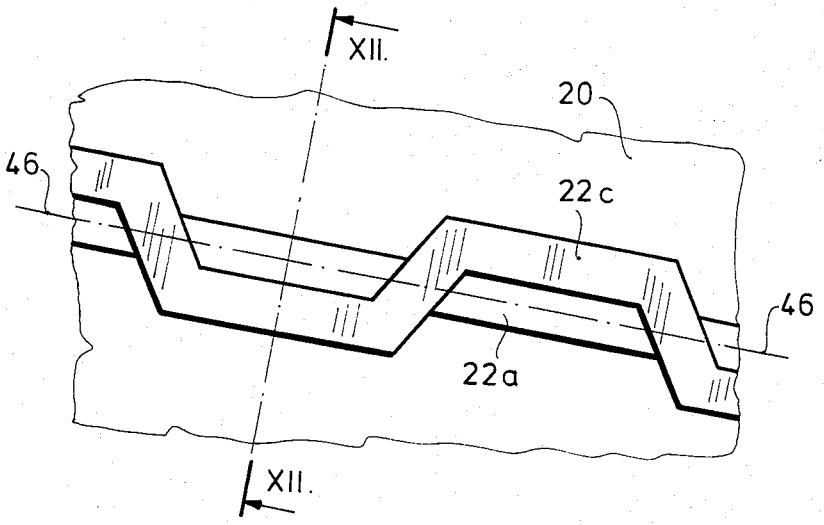
FIG. 11 represents a side elevational view of a detail of a further exemplified embodiment.

Such an embodiment is shown by way of example in FIG. 11 where ripples 22*c* have trapezoid shaped cross sectional areas. At the angles of the trapezoid the air flow parts with the ripple surface and becomes turbulent, whereby laminar flow is practically destroyed.

Obviously, cross sectional configurations other than trapezoids may be selected as well. For instance, the ripples may have cross sectional configurations in the form of acute-angled triangles. Other forms of cross section may suit in a like manner provided the depth of the ripples diminishes toward the center of the finned tube as is required in compliance with the main feature of the invention.

Figure 12:
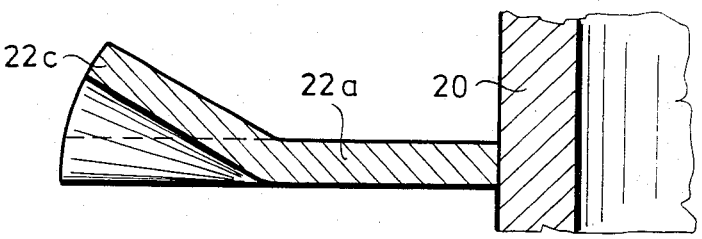
FIG. 12 illustrates a cross sectional view taken along the line XII—XII of FIG. 11.

In the case of both embodiments shown in FIGS. 10 and 11, a radial cross sectional view of a turn 22*a* is illustrated in FIG. 12.

Turns 22*a* may be fixed to a tubular member 20 by means of any of conventional methods such as welding, soldering, immersing in metal baths and the like. Furthermore, the turns may be fitted into grooves on the cylindrical surface of the tubular member, fixing being achieved by deforming the groove sides and pressing them onto the base of the turns. Helical members may be produced by employing bands of L-shaped cross sectional area of unequal legs. Upon winding the band onto the tubular member the shorter leg of the band will cover the tubular member between subsequent turns in the manner of a sleeve. As has been mentioned above, it is also possible to die-roll the fins from the body of the tubular member in which case the tubular member and helical member are integral with one another and the fin gaps widen toward the priphery of the fins. Irrespective of the manner of manufacture it is important that the generatrix of the turns be perpendicular to the generatrices of the tubular member or, what is the same, to the principal axis of the latter because such mutual positions of tubular member and turns is of high significance with respect to both manufacturing technology and thermodynamic operational conditions. Namely, in the case of helical members the generatrix of the turns of which is perpendicular to the generatrices of the tubular member, ripples may easily be provided prior as well as after winding up of a band. Even die-rolled fins may be rippled during or after die-rolling. As regards thermodynamics, turns the generatrix of which is perpendicular to the generatrices of the tubular member ensure a maximum contact area between a cooling medium and a finned tube.

Hereinbefore it has mostly been assumed that the tubular member has a medium of higher heat transfer coefficient such as water or condensing vapour or steam flowing in it while outside the tubular member between the fins a medium of lower heat transfer coefficient such as cooling air is flowing. However, a finned tube according to the invention is, independent of the nature of the media participating in a heat exchange and of the direction of the latter, applicable everywhere where the heat of a medium of higher heat transfer coefficient is to be transferred into a medium of lower heat transfer coefficient. Thus, e.g. condensing gases, mixtures of vapours and liquids as well as gases other than air may be processed by means of finned tubes according to the invention.

Such tubes are particularly suitable for being used in heat exchangers. However, it will be appreciated that they will suitably work in other cases or as individual pieces as well where a heat transfer is aimed at between media of different heat transfer coefficients.

We claim:

1. In a helicoidally finned heat exchange tube, comprising an inner tubular member and an outer helical member, the helical member having substantially circular and solid turns perpendicular to the surface of the tubular member and having ripples which extend inwardly from the outer periphery of the turns and the depths of which decrease radially inwardly, adjacent turns being separated from one another by a substantially continuous gap; the improvement in which the helical member (22) has rippled sections (S1, S2) alternating with level sections, the rippled sections subtending an angle not exceeding about 90 degrees and the level sections having a continuous smooth surface, and both types of sections on successive turns registering with one another in the direction of the axis (32) of the tubular member (20) and the level sections on successive turns defining between them gaps confined by walls having smooth surfaces, thereby facilitating a cleaning of said gaps between said smooth surfaces following deposit of solids in said gaps between said smooth surfaces from gas flowing in a direction perpendicular to the bisector of said angle subtended by said rippled sections, the spacing of the sections being substantially equal to a quarter of the circumference of the tubular member so that the rippled sections of the helical member occupy diametrically opposite positions on the tubular member.

* * * * *